US009909749B2

(12) United States Patent
Barnas

(10) Patent No.: US 9,909,749 B2
(45) Date of Patent: Mar. 6, 2018

(54) LIGHT ACCESSORY USING MICROPHONE STAND/CLAMP

(71) Applicant: Michael Barnas, Fruitland, MD (US)

(72) Inventor: Michael Barnas, Fruitland, MD (US)

( * ) Notice: Subject to any disclaimer, the term of this patent is extended or adjusted under 35 U.S.C. 154(b) by 99 days.

(21) Appl. No.: 15/151,681

(22) Filed: May 11, 2016

(65) Prior Publication Data

US 2016/0334095 A1 Nov. 17, 2016

Related U.S. Application Data

(60) Provisional application No. 62/159,536, filed on May 11, 2015.

(51) Int. Cl.

| | |
|---|---|
| ***F21S 9/02*** | (2006.01) |
| ***F21V 23/04*** | (2006.01) |
| ***F21S 6/00*** | (2006.01) |
| ***F21V 21/116*** | (2006.01) |
| *F21Y 105/10* | (2016.01) |
| *F21Y 115/10* | (2016.01) |
| *F21Y 103/33* | (2016.01) |

(52) U.S. Cl.

CPC ..... *F21V 23/0485* (2013.01); *F21S 6/008* (2013.01); *F21S 9/02* (2013.01); *F21V 21/116* (2013.01); *F21V 23/0435* (2013.01); *F21Y 2103/33* (2016.08); *F21Y 2105/10* (2016.08); *F21Y 2115/10* (2016.08)

(58) Field of Classification Search

CPC ..... F21V 23/0485; F21V 23/0435; F21V 21/116; F21V 21/08; F21V 21/02; F21V 21/088; F21S 6/008; F21S 9/02; F21S 8/03; F21S 8/08; F21S 8/04; G06F 3/04847; G06F 3/0488; F21Y 2103/33; F21Y 2115/10; F21Y 2105/10; F21W 2131/00; F21W 2101/00; F21W 2121/00

See application file for complete search history.

(56) References Cited

U.S. PATENT DOCUMENTS

| | | | | |
|---|---|---|---|---|
| 5,765,793 | A * | 6/1998 | Yu | F21S 6/003 248/126 |
| 8,568,162 | B1 * | 10/2013 | White | H04R 1/026 439/574 |
| 9,719,627 | B2 * | 8/2017 | Hennessey | F16M 11/2021 |
| 9,726,961 | B2 * | 8/2017 | Myers | G03B 17/561 |
| D797,549 | S * | 9/2017 | Dew | D8/394 |
| 2006/0193141 | A1 * | 8/2006 | Farmer | A47B 57/565 362/382 |
| 2007/0252919 | A1 * | 11/2007 | McGreevy | F16M 11/10 348/825 |
| 2009/0249993 | A1 * | 10/2009 | Dowler | G09F 3/205 116/310 |
| 2015/0016114 | A1 * | 1/2015 | Marquardt | F21V 21/26 362/253 |
| 2016/0139495 | A1 * | 5/2016 | O'Neill | G03B 17/565 396/530 |

* cited by examiner

*Primary Examiner* — Joseph L Williams
*Assistant Examiner* — Jose M Diaz
(74) *Attorney, Agent, or Firm* — Nixon & Vanderhye P.C.

(57) ABSTRACT

One or more components of an existing microphone clamp/stand may be used to support a light source. The light source may be attachable to one part of the existing microphone clamp, or the light source itself may be formed into the shape of a microphone so that it can be readily secured in the existing microphone clamp.

11 Claims, 6 Drawing Sheets

LIGHT ACCESSORY USING MICROPHONE STAND/CLAMP

CROSS-REFERENCES TO RELATED APPLICATIONS

This application claims the benefit of U.S. Provisional Patent Application No. 62/159,536, filed May 11, 2015, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The invention relates to a light accessory using a microphone stand/clamp.

It is desirable for a musician or performer to have access to a light source while performing for both visibility (reading sheet music) and ambiance. Lamps and other conventional light sources, however, are not amenable to use in a performance environment.

BRIEF SUMMARY OF THE INVENTION

Exemplary embodiments of the present invention utilize one or more components of an existing microphone clamp/stand to support a light source. The light source may be configured to be attachable to one part of the existing microphone clamp, or the light source itself may be formed into the shape of a microphone so that it can be readily secured in the existing microphone clamp.

In an exemplary embodiment, a light accessory includes a clamp base securable to a microphone stand and a lamp unit selectively attachable to the clamp base. The clamp base has a slot connector or a tab connector. The lamp unit has a light source and the other of the slot connector and the tab connector. The slot and tab connectors are securable together with a coupling member. The light source may include an LED panel, which may be integral with the other of the slot connector and the tab connector. The lamp unit may include a housing and a printed circuit board disposed in the housing, and the printed circuit board may include capacitive-touch sensors for controlling the lamp unit. The lamp unit may include communication hardware connectable wirelessly with an external device. The communication hardware may include at least one of Wi-Fi access and Bluetooth connectivity. The lamp unit may be DMX compatible.

In another exemplary embodiment, a light accessory includes a microphone clamp securable to a microphone stand, and a lamp unit selectively attachable to the microphone clamp, where the lamp unit includes a light source. In some embodiments, the microphone clamp may include a microphone clamp base, where the light accessory further includes a microphone holder attachable to the microphone clamp base. In this context, the lamp unit may include a housing formed into a microphone shape and secured in the microphone holder. A battery receptacle may be provided in the housing, and a battery for powering the lamp unit may be disposed in the battery receptacle.

In yet another exemplary embodiment, a method of assembling a light accessory using a microphone clamp having a clamp base and a microphone holder includes the steps of detaching the microphone holder from the clamp base, and securing a lamp unit to the clamp base; or providing a lamp unit with a housing in a microphone shape, and securing the lamp unit to the microphone holder. The step of securing the lamp unit to the clamp base may be practiced by coupling the other of the slot connector and the tab connector to the one of the slot connector and the tab connector and securing a coupling member through the slot connector and the tab connector.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
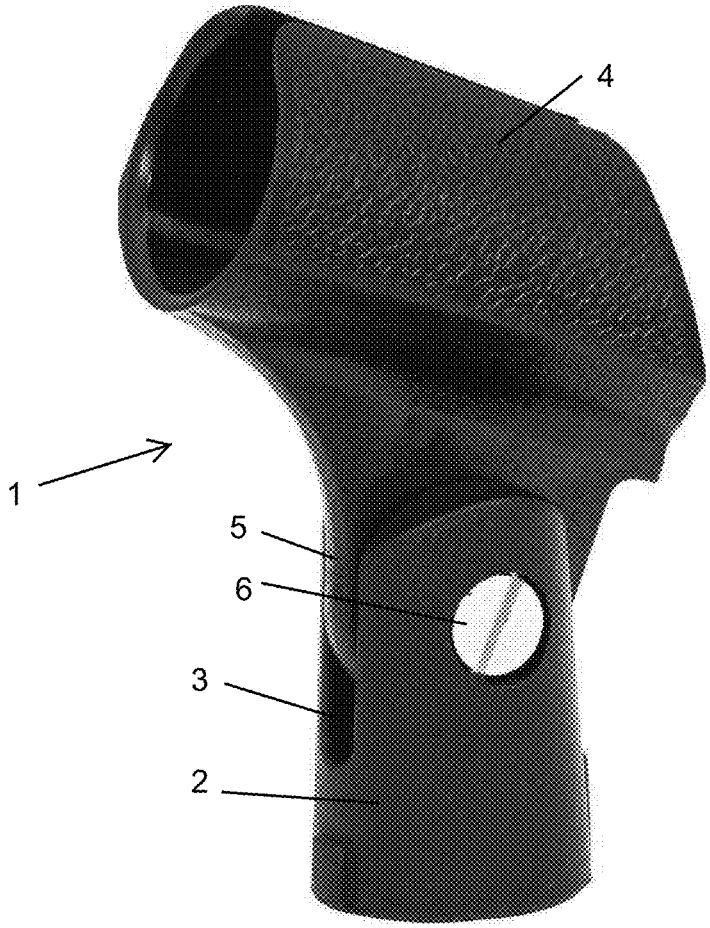
FIG. 1 is a perspective view of a microphone clamp securable to a mic stand.

FIG. 1 shows an existing microphone clamp 1 that may be secured at an uppermost end of a microphone stand. The clamp 1 includes a clamp base 2 that is typically secured to the mic stand and includes a slot 3. A mic holder 4 is configured to receive a microphone in a channel and includes a tab member 5 cooperable with the slot 3 in the clamp base 2. The mic holder 4 is secured to the clamp base 2 by a connector 6 that extends through the slot 3 and tab 5.

Figure 2:
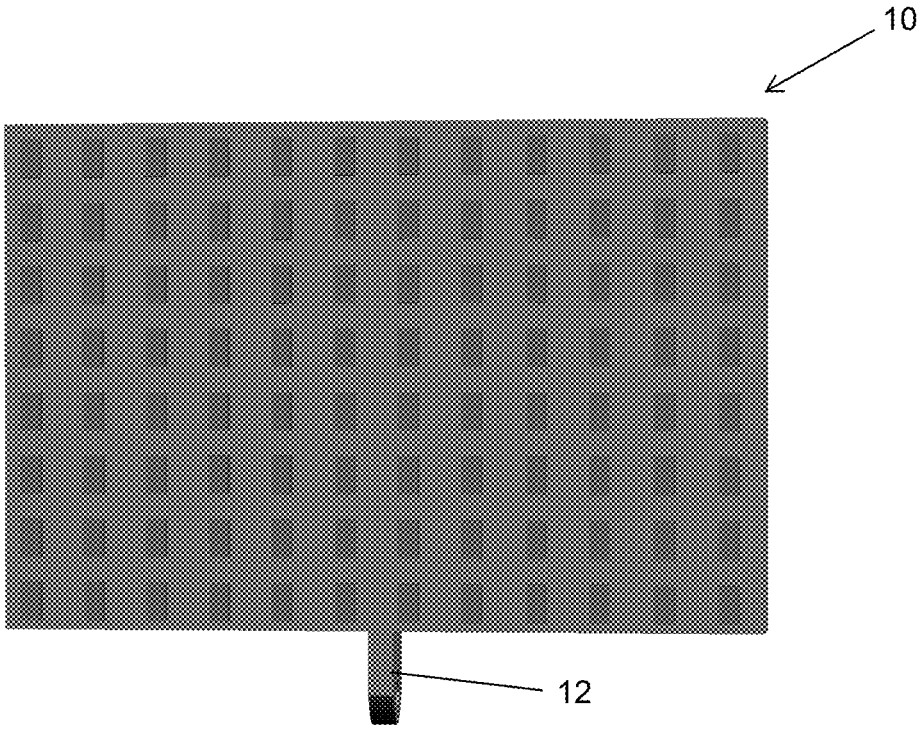
FIG. 2 shows a light panel or LED panel that is cooperable with one part of the existing microphone clamp.
Figure 3:
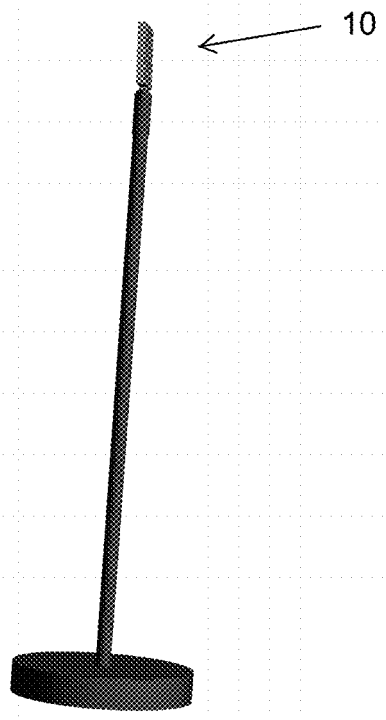
FIG. 3 shows the mic stand including an attached light panel.

With reference to FIG. 2, a lightweight LED light or light panel 10 is provided with an attached or integral tab member 12 that is sized to fit in the existing slot 3 of the mic clamp base 2. To secure the panel 10, the user need only unscrew the connector 6 for the mic holder 4, position the panel into the slot 3, and re-connect the connector 6. FIG. 3 shows an assembled light accessory.

In some embodiments, the LED panel/board 10 or the like will be under 1.5 lbs (a good standard for heavy microphones) allowing it to be mounted to any kind of mic stand—be that a stationary stand or a boom-style stand.

The light accessory is inexpensive and would replace existing heavy light systems that typically cost several hundreds of dollars, take up large amounts of space and several minutes (sometimes 10-15) to setup then teardown, which is unrealistic for a small band. The design according to the described embodiments could be manufactured for about $50 or less, can be setup then later put away in less than a minute, and will take up no more room during transportation than a single additional microphone stand (something musicians commonly have on-hand).

Figure 4:
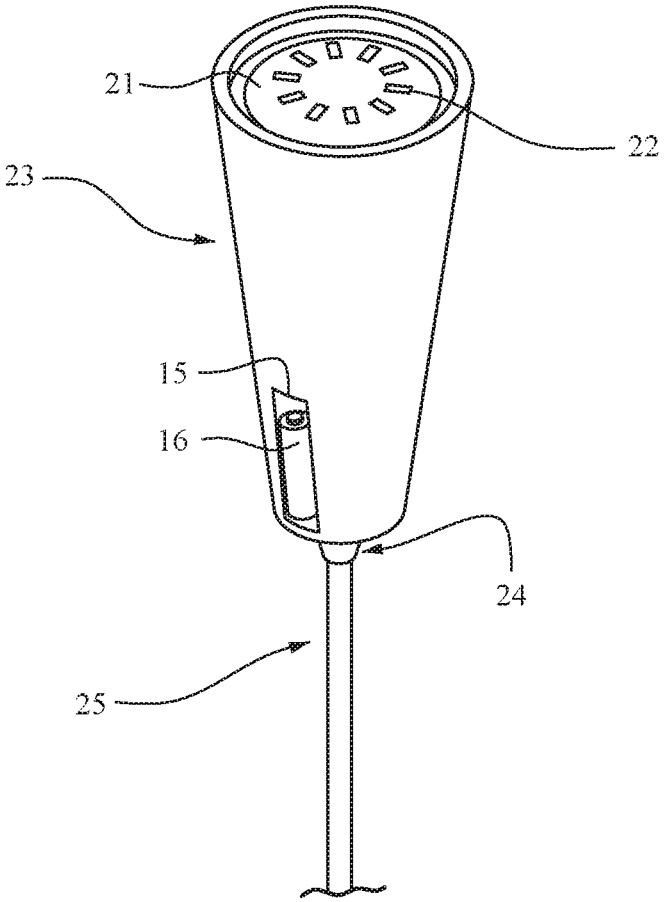
FIG. 4 shows the light accessory formed into the shape of a microphone.

With reference to FIG. 4, in an alternative embodiment, a similar light fixture may be molded into the shape of a microphone so the accessory itself actually slides into the standard mic clip. The fixture may include a printed circuit board (PCB) 21 encased in a suitable housing 23 for protection and durability. The housing 23 may resemble a standard size dynamic microphone as to easily slip into the standard microphone clip shown in FIG. 1. The housing 23 may be machined aluminum or molded plastic.

The base of the housing 23 can be provided with a battery compartment 15 so that a battery 16 may be inserted to power the light accessory using direct current. The battery may be easily removable so as to allow a musician to carry extra (charged) batteries and swap in a matter of seconds when necessary.

Figure 5:
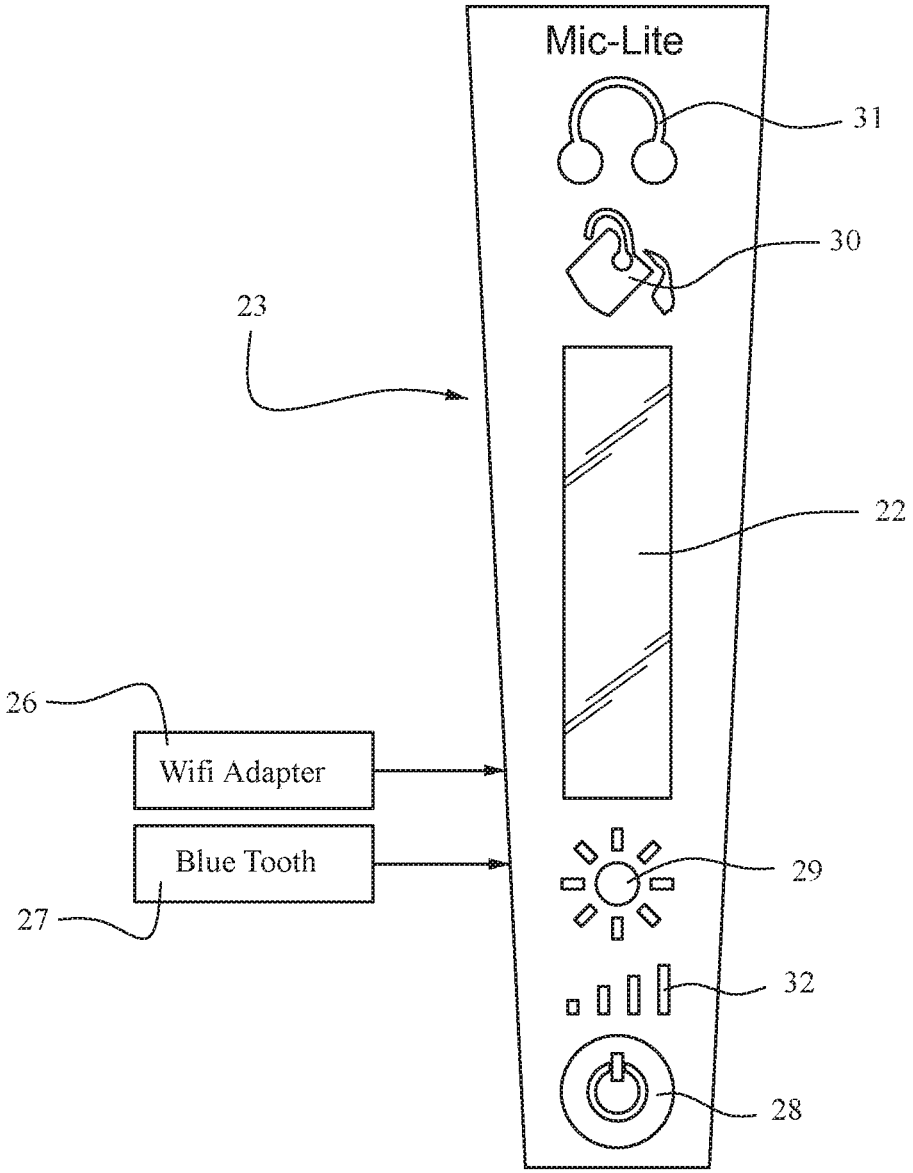
FIG. 5 shows an exemplary housing and control features for the light accessory.

The light accessory in all of the described embodiments may be controlled via capacitive-touch sensors operable on the printed circuit board positioned in the accessory housing 23. See, e.g., FIG. 5. Users will also have the ability to alter functions of the light accessory via a smart phone application using WiFi 26 or Bluetooth 27 connectivity, or by physically interacting with the light accessory's capacitive-touch sensors. The circuit board 21 may feature LEDs 22 and other microelectronics allowing it to toggle the light accessory ON/OFF via power switch 28 and change colors with the addition of RBG (Red Green Blue Alpha) LEDs based on audio input, user input, or preset dynamic lighting programs. The capacitive-touch controlled printed circuit board 21 will take inputs from a user's finger and apply outputs such as change brightness 29, select lighting program or a static color 30, and toggle audio-sense function 31. A WiFi signal strength indicator 32 may also be included. The LEDs may be soldered to the PCB along with other required micro-electronics (resistors, capacitors, etc.) as would be apparent to those of ordinary skill in the art. The fixture can be DMX compatible so as to allow for external control through industry standard lighting controllers.

Figure 6:
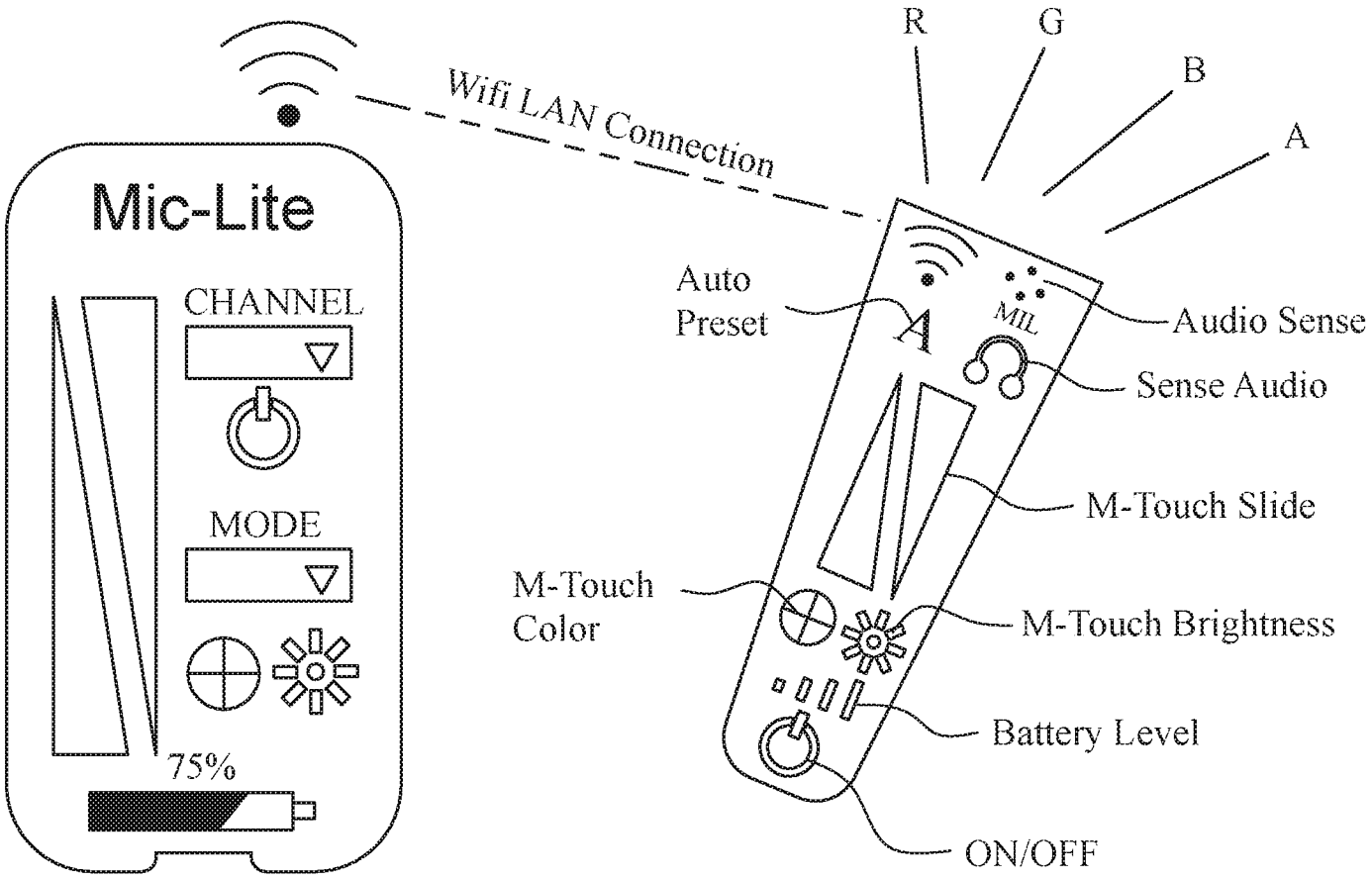
FIG. 6 shows the accessory in communication with a phone app.

FIG. 6 shows a lighting accessory linked with a phone app. An exemplary screen shot from the phone app is shown. The housing layout and control modes may be implemented as follows:

- M-Touch Pads—0.5"×0.5"
  - Audio Sense (Headphones)
    - ON
      - Illuminate white LED backlight
      - Sense audio signals using internal mic and apply color changing frequency based on sound inputs
    - OFF
      - LED backlight is turned OFF
      - Revert to default color changing program
  - Color Change (Paint Bucket)
    - ON
      - Illuminate white LED backlight
      - Apply manual color-change setting based on user input on the touch slider. Default to blue until user touches slider and changes the color
    - OFF
      - LED backlight is turned OFF
      - Revert to default color changing program
  - Touch Slider (M-touch slider, 2"×0.5")
    - DEFAULT
      - Allow user inputs to change the frequency of the color scrolling in the default program (slow scroll to fast scroll)
    - COLOR CHANGE
      - Allow user inputs to change the color output of the light manually. Remain static color until color change button is toggled OFF, or audio input button is toggled ON
    - BRIGHTNESS
      - Allow user inputs to change the brightness of the light output—whether that output is one static color, an audio sensing color scroll show, or the default color scrolling program. Default to 75% brightness
  - Brightness (Sun)
    - ON
      - Illuminate white LED backlight
      - Toggle touch slider to brightness changing mode and take user inputs to change the overall brightness of the unit's light output
    - OFF
      - LED backlight is turned OFF
      - Touch slider reverts back to default input setting, which changes the frequency of the lighting program's color change-scrolling Modes:

1. Default Program
   - a. Audio Sense=OFF
   - b. Color Change=OFF
   - c. Touch Slider=Take inputs to alter frequency of default color changing program OR take inputs to change the brightness
   - d. Brightness=OFF (Default)/ON
2. Audio Input Program
   - a. Audio Sense=ON
   - b. Color Change=OFF
   - c. Touch Slider=Take inputs to change the brightness
   - d. Brightness=ON
3. Manual Color Program
   - a. Audio Sense=OFF
   - b. Color Change=ON
   - c. Touch Slider=Take inputs to change the color OR take inputs to change the brightness of said color
   - d. Brightness=OFF (Default)/ON The lighting accessory of the described embodiments advantageously utilizes one or more components of an existing microphone clamp/stand to support a light source. The light source may be configured to be attachable to one part of the existing microphone clamp, or the light source itself may be formed into the shape of a microphone so that it can be readily secured in the existing microphone clamp. Additional features provide for added functionality.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A light accessory comprising:

a clamp base securable to a microphone stand, the clamp base including one of a slot connector and a tab connector;

a lamp unit selectively attachable to the clamp base, the lamp unit including a light source and the other of the slot connector and the tab connector, wherein the other of the slot connector and the tab connector is engageable with the one of the slot connector and the tab connector; and a coupling member secured through the slot connector and the tab connector.

2. A light accessory according to claim 1, wherein the light source comprises an LED panel.

3. A light accessory according to claim 2, wherein the LED panel is integral with the other of the slot connector and the tab connector.

4. A light accessory according to claim 1, wherein the lamp unit comprises a housing and a printed circuit board disposed in the housing, the printed circuit board including capacitive-touch sensors for controlling the lamp unit.

5. A light accessory according to claim 1, wherein the lamp unit comprises communication hardware connectable wirelessly with an external device.

6. A light accessory according to claim 5, wherein the communication hardware comprises at least one of Wi-Fi access and Bluetooth connectivity.

7. A light accessory according to claim 1, wherein the lamp unit is DMX compatible.

8. A light accessory comprising:

a microphone clamp securable to a microphone stand, wherein the microphone clamp comprises a microphone clamp base;

a lamp unit selectively attachable to the microphone clamp, the lamp unit including a light source;

a microphone holder attachable to the microphone clamp base, wherein the lamp unit comprises a housing formed into a microphone shape and securable in the microphone holder; and a battery receptacle in the housing and a battery for powering the lamp unit disposed in the battery receptacle.

9. A light accessory according to claim 8, the microphone clamp including one of a slot connector and a tab connector, wherein the lamp unit includes the other of the slot connector and the tab connector, wherein the other of the slot connector and the tab connector is engageable with the one of the slot connector and the tab connector, and wherein a coupling member is secured through the slot connector and the tab connector.

10. A method of assembling a light accessory using a microphone clamp having a clamp base and a microphone holder, the method comprising:

detaching the microphone holder from the clamp base, and securing a lamp unit to the clamp base; or providing a lamp unit with a housing in a microphone shape, and securing the lamp unit to the microphone holder.

11. A method according to claim 10, wherein the clamp base includes one of a slot connector and a tab connector, and wherein the lamp unit includes a light source and the other of the slot connector and the tab connector, the step of securing the lamp unit to the clamp base being practiced by coupling the other of the slot connector and the tab connector to the one of the slot connector and the tab connector and securing a coupling member through the slot connector and the tab connector.

* * * * *